US007185622B2

(12) United States Patent
Doll

(10) Patent No.: US 7,185,622 B2
(45) Date of Patent: Mar. 6, 2007

(54) METHOD AND APPARATUS FOR INTERCONNECTING A COIL AND A SPARK PLUG

(76) Inventor: Martin J. Doll, 3900 Springbrooke Cove, Louisville, KY (US) 40241

( * ) Notice: Subject to any disclaimer, the term of this patent is extended or adjusted under 35 U.S.C. 154(b) by 0 days.

(21) Appl. No.: 11/079,854

(22) Filed: Mar. 14, 2005

(65) Prior Publication Data

US 2005/0199411 A1 Sep. 15, 2005

Related U.S. Application Data

(60) Provisional application No. 60/552,875, filed on Mar. 12, 2004.

(51) Int. Cl.
*H01T 13/02* (2006.01)
*H01T 13/04* (2006.01)

(52) U.S. Cl. ..... 123/169 PA; 123/143 C

(58) Field of Classification Search ..... 123/169 PA, 123/143 C; 174/86; 439/502, 504, 125, 439/126, 127, 128
See application file for complete search history.

(56) References Cited

U.S. PATENT DOCUMENTS 4,590,536 A * 5/1986 Gerry ..... 361/253
4,754,102 A * 6/1988 Dzurak ..... 174/36
5,064,966 A * 11/1991 Palmer ..... 174/32
5,603,306 A * 2/1997 Tai ..... 123/633
6,374,816 B1 * 4/2002 Funk et al. ..... 123/605
6,427,673 B2 * 8/2002 Morganti et al. ..... 123/633
6,508,216 B2 * 1/2003 Holmes et al. ..... 123/169 PA
6,615,810 B2 * 9/2003 Funk et al. ..... 123/605
6,682,357 B2 * 1/2004 Sikora et al. ..... 439/125
6,845,764 B1 * 1/2005 Skinner et al. ..... 123/634
2001/0032636 A1 * 10/2001 Morganti et al. ..... 123/633
2003/0181081 A1 * 9/2003 Sikora et al. ..... 439/125
2006/0089024 A1 * 4/2006 Kraus et al. ..... 439/125

* cited by examiner

*Primary Examiner*—Mahmoud Gimie
(74) *Attorney, Agent, or Firm*—Wyatt, Tarrant & Combs, LLP

(57) ABSTRACT

The present invention is directed to a method and assembly for conducting electrical current between a coil and a spark plug of an engine. The ignition wire utilized for this conduction of electrical current generally includes a plug terminal located at a first end of the ignition wire that is electrically connectable with a spark plug. In addition, the ignition wire includes a voltage source terminal disposed at a second end of the ignition wire opposite the first end. This voltage source terminal is generally electrically interconnectable with a voltage source of an engine such as a coil. In one embodiment, this ignition wire may be characterized as including a plurality of wires arranged as a cable. Further, one embodiment of the ignition wire may be said to be substantially non-stretchable. Still further, one embodiment may be designed to provide an electrical resistance of no more than about 4.0 ohms.

23 Claims, 4 Drawing Sheets

METHOD AND APPARATUS FOR INTERCONNECTING A COIL AND A SPARK PLUG

CROSS-REFERENCE TO RELATED APPLICATIONS

This application claims priority of U.S. Provisional Application Ser. No. 60/552,875, filed Mar. 12, 2004 which is fully herein incorporated by reference.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention generally relates to motor vehicles, and more particularly to method and apparatus for interconnecting a coil and a spark plug of motor.

BACKGROUND OF THE INVENTION

Spark ignition internal combustion engines such as are used in automobiles have traditionally employed mechanical and/or electronic distributors to route high voltage energy from an ignition coil to the engine spark plugs. More recently, distributorless ignition systems have been employed in which a separate ignition coil is provided for every one or two spark plugs. In some cases, the coils are generally located above the spark plug(s). In other cases, the coils are integrated together into a common housing or assembly for installation above the spark plugs as a single unit.

FIG. 1 illustrates another manner in which conventional engines provide high voltage energy to a spark plug. More particularly, FIG. 1 illustrates what is referred to in the art as a coil-on-plug (COP) assembly 10 that includes a conventional ignition wire 12. This ignition wire 12 (also shown in FIG. 2) may be characterized as a spring of sorts that has a voltage source end 14 that, when in use, is electrically interconnected with a coil (not shown) disposed within a coil portion 13 of an insulative boot 20 of the COP assembly 10. In addition, this ignition wire 12 has a plug end 16 that, when in use, is electrically interconnected to a spark plug 18.

It has been found that deployment of the ignition wire 12 in the COP assembly 10 is problematic. For instance, due to the conventional design of the ignition wire 12, during use the plug end 16 of the same tends to melt and at least generally adhere the ignition wire 12 to the spark plug 18. This results in increased labor when it comes time to replace the spark plug 18. Moreover, even if the plug end 16 of the ignition wire 12 does not meltingly adhere to the spark plug 18, the amount of force utilized to dissociate the spark plug 18 from the plug end 16 of the ignition wire 12 generally causes the spring-shaped ignition wire 12 to stretch without recoiling back to its original length. This stretching of the ignition wire 12 may undesirably result in a portion of the ignition wire 12 extending out beyond a plug end 19 of the insulative boot 20. Once this ignition wire 12 has been stretched, it generally quite difficult to return the ignition wire 12 to its original length. Accordingly, the simple task of replacing the spark plug 18 associated with this COP assembly 10 may undesirably be accompanied by replacement of the ignition wire 12 or even the entire COP assembly 10. This adds undesired expense and time to the task of replacing the spark plug 18.

In addition to the above-described problems associated with the ignition wire 12, the conventional type of ignition wire 12 also has been shown to provide a resistance of no less than about 6 ohms. Accordingly, the performance of the engine is at least generally hindered with the deployment of this ignition wire 12 in the COP assembly 10.

SUMMARY OF THE INVENTION

Accordingly, it is an object of the present invention to provide an ignition wire assembly that is substantially non-stretchable. Another object of the present invention to provide an ignition wire assembly that is more durable than conventional ignition wires. Still another object of the invention is to provide an ignition wire assembly that improves performance. Yet another object of the present invention is to reduce the cost and time associated with replacing a spark plug. Still yet another objective is to provide a coil-on-plug assembly that addresses at least some of the shortcomings of the prior art. These objects, as well as others, may be met by the following invention.

One aspect of the invention is directed to an ignition wire assembly for a motor vehicle. This ignition wire assembly generally includes an ignition wire that has plug terminal that is generally found at a first end of the ignition wire and that is electrically connectable with at least a portion of a spark plug. Moreover, a voltage source terminal is generally found at a second end of the ignition wire opposite the first end. This voltage source terminal is generally electrically interconnectable with a voltage source such as, for example, a coil of an engine.

This inventive ignition wire may be designed as a cable or cord of sorts. So, in one characterization, the ignition wire may at least generally be characterized as a plurality of wires that are at least one of twisted together, braided, woven, or the like to make up the ignition wire. By contrast, in another embodiment, the ignition wire may be designed as a unitary piece of conductive material such as, but not limited to, a tube or rod of sorts.

The ignition wire may be characterized as being substantially non-stretchable. Herein, "non-stretchable" or the like generally means that a length of the ignition wire retains its integrity (length and shape) and does not significantly change upon exposure to forces normally imposed thereon during normal spark plug replacement procedures. By way of example, it may be said that the ignition wire is designed to avoid any significant amount of stretching or extension when exposed to a pulling force of about 25 foot-pounds. Indeed, the ignition wire may be designed to avoid any significant amount of stretching when exposed to a pulling force of between about 25 foot-pounds and about 50 foot-pounds in one embodiment, a pulling force of between about 50 foot-pounds and about 100 foot-pounds in another embodiment, a pulling force of between about 100 foot-pounds and about 200 foot-pounds in still another embodiment, and a pulling force of more than about 200 foot-pounds in yet another embodiment.

The ignition wire may be made of any of a number of appropriate conductive materials. For instance, the ignition wire may be made of stainless steel. While not critical to this first aspect of the invention, it is generally preferred that that ignition wire be made of a conductive material that is non-corrosive or at least generally hinders corrosive processes.

The ignition wire may exhibit any appropriate dimensions. For example, the ignition wire may have any of a number of appropriate lengths. As another example, the ignition wire may exhibit any of a number of appropriate diameters. The wire may be woven of many small diameter strands or fewer large diameter strands to form a conductor of a cross section providing the requisite low resistance for the conduction of the electric al energy to the spark plug. Indeed, the diameter of one preferred embodiment of the ignition wire maybe about 3/16 inch, which maybe varied as is known in the art according to the relative conductivity of the wire material chosen. Varying embodiments may range from about 1/8 inch to about 1/4 inch or more.

Some embodiments of the invention may include a radio frequency interference hindering device of sorts, as by electrically shielding a portion of the wire. This device may be any of a number of appropriate devices for at least generally hindering emission of radio frequency interference from the ignition wire. For instance, this device may be a ferrite collar that is disposed about the ignition wire for as little as less than an inch to up to two inches, or more, depending upon material and flexibility.

Another aspect of the present invention is directed to a method of conducting electricity between a voltage source and a spark plug in an engine. In this method, electrical energy from a coil of an engine is provided to an ignition wire. Further, the electrical energy is conducted at least generally through the ignition wire and to a spark plug. This ignition wire is generally designed so that it can conduct the electrical energy while providing a resistance of no more than about 5.0 ohms.

The resistance provided by the ignition wire may be no more than about 4.0 ohms in one embodiment, no more than about 3.0 ohms in another embodiment, no more than about 2.0 ohms in still another embodiment, and no more than about 1.0 ohm in yet another embodiment. Indeed, one embodiment of the ignition wire may provide a resistance of no more than about 0.75 ohm, another embodiment may provide a resistance of no more than about 0.50 ohm, and still another embodiment may provide a resistance of no more than about 0.25 ohm. In fact one embodiment of the invention may include an ignition wire that provides substantially no resistance to the conduction of electrical energy. Incidentally, while a resistance of less than about 5.0 ohms is preferred, other embodiments of the invention may utilize ignition wires providing other appropriate resistances.

Various refinements exist of the features noted in relation to the above-described aspects of the present invention, and further features may also be incorporated as well. These refinements and additional features may exist individually or in any combination. Generally, each of the various features and refinements discussed herein in relation to the present invention maybe utilized alone or in any combination in any of the aspects of the present invention.

DETAILED DESCRIPTION OF THE DRAWINGS

Figure 1:
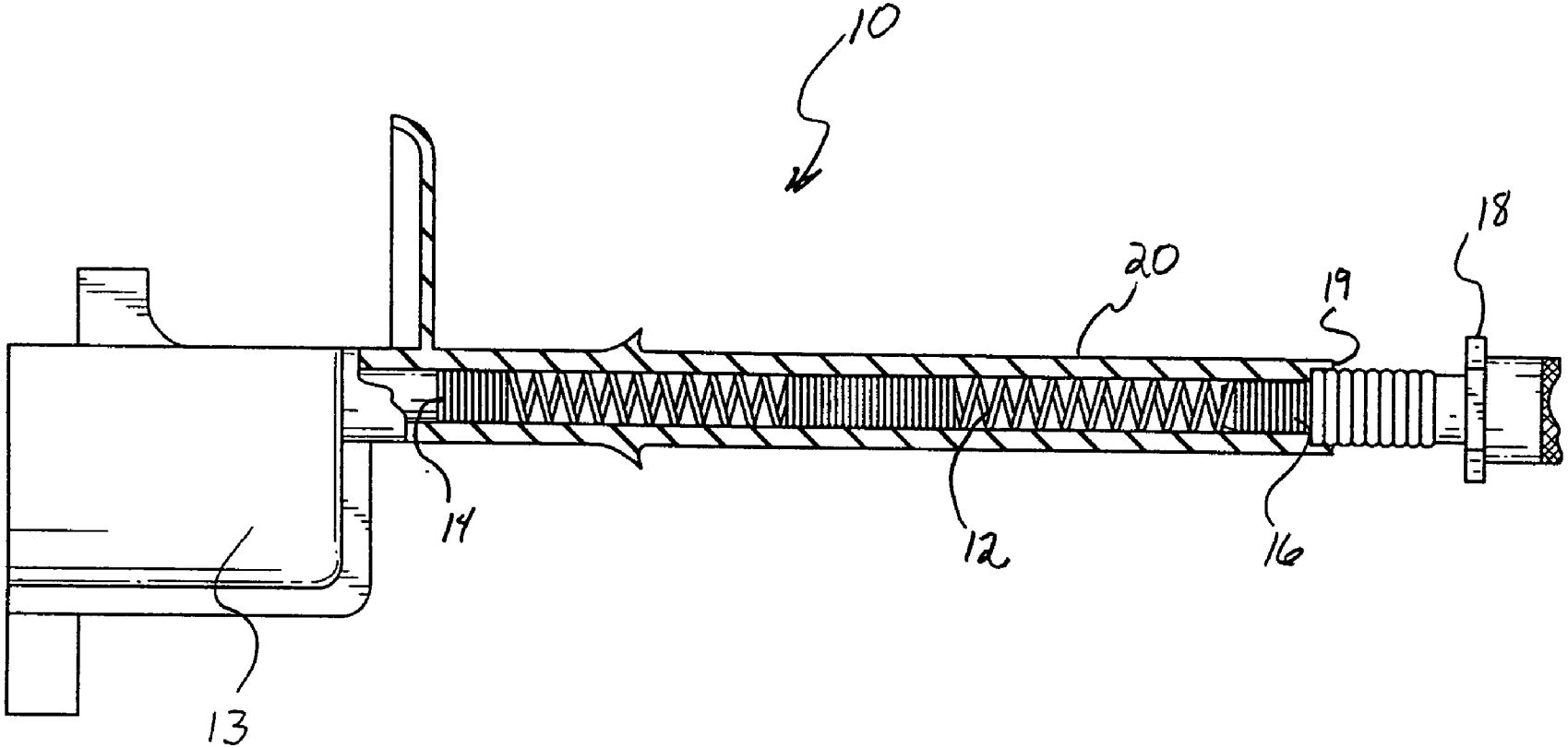
FIG. 1 (Prior Art)
FIG. 1 is a partial cutaway view of a conventional, prior art coil-on-plug assembly.
Figure 2:
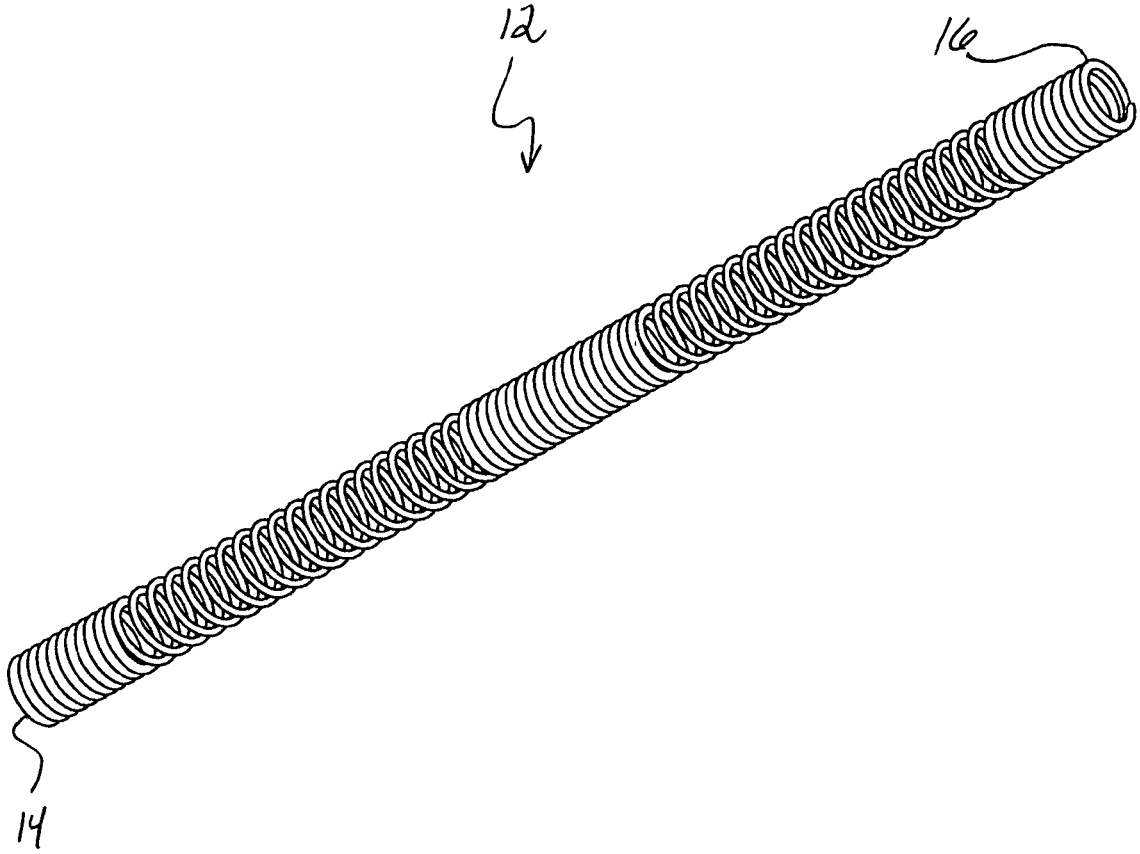
FIG. 2 (Prior Art)
FIG. 2 is a perspective view of the ignition wire of the coil-on-plug assembly of FIG. 1.
Figure 3:
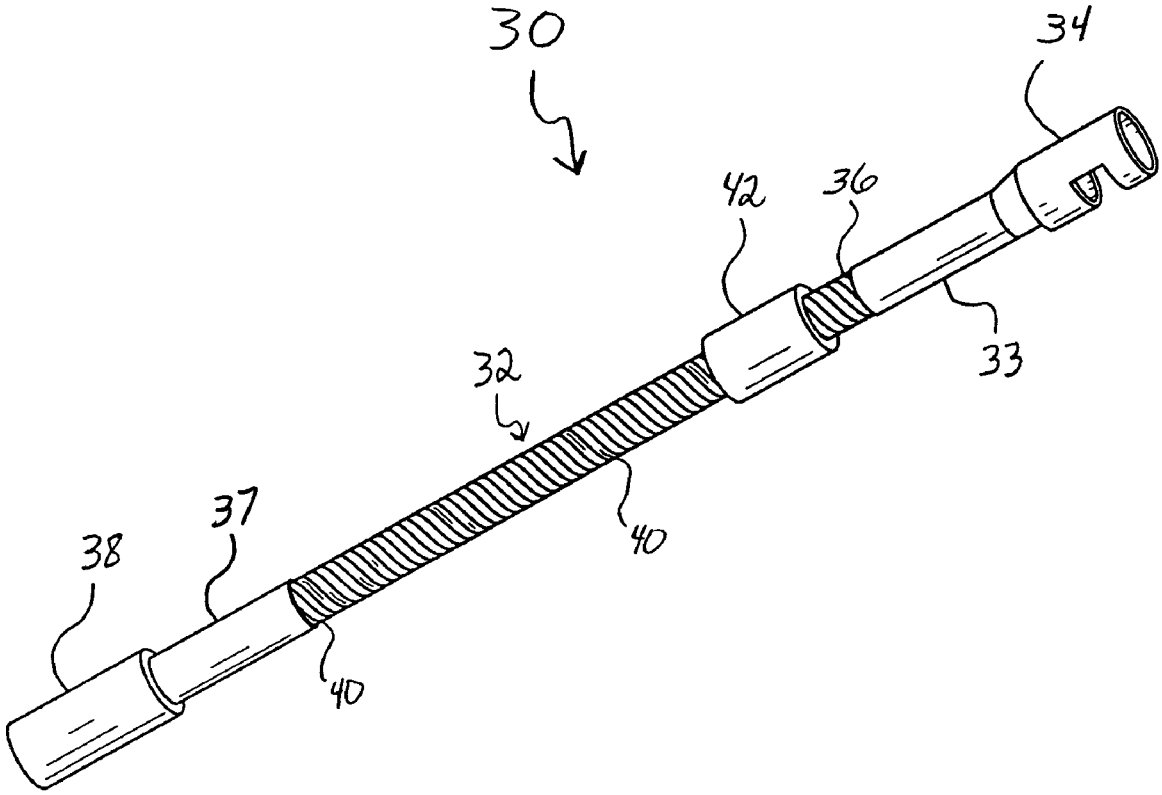
FIG. 3 is a perspective view of an ignition wire assembly of the invention.

The present invention will now be described in relation to the accompanying drawings, which at least assist in illustrating the various pertinent features thereof. FIGS. 1 and 2 illustrate a prior art coil in plug type of spark plug lead. FIG. 3 illustrates an ignition wire assembly 30 that may be utilized to conduct electrical energy between a voltage source and a spark plug. This ignition wire assembly 30 includes an ignition wire 32 that has plug terminal 34 located toward a first end 36 of the ignition wire 32 and a voltage source terminal 38 located toward a second opposing end 40 of the ignition wire 32. More particularly, the plug terminal 34 is interconnected with the first end 36 of the ignition wire 32 via a clamping component 33 of the plug terminal 34. This plug terminal 34 may be said to be electrically connectable with at least a portion of a spark plug. Accordingly, while this plug terminal 34 may be made of any appropriate conductive material, it is preferably made of stainless steel, zinc plated steel, or brass, as representative of conductive metals which are also resistant to corrosion. It should be noted that the actual design of the plug terminal 34 is irrelevant. Accordingly, any appropriate terminal may be employed as the plug terminal 34 as long as the terminal can be utilized to conduct electrical energy between the ignition wire 32 and a spark plug.

The voltage source terminal 38 of the ignition wire assembly 30 is interconnected with the second end 40 of the ignition wire 32 via a clamping component 37 of the voltage source terminal 38. This voltage source terminal 38 is generally electrically interconnectable with a voltage source such as, for example, an ignition coil of an internal combustion engine. Accordingly, any material that is appropriate for the make-up of the plug terminal 34 may be utilized to make up the voltage source terminal 38. As with the plug terminal 34, the actual design of the voltage source terminal 38 is irrelevant. As such, any appropriate terminal may be employed as the voltage source terminal 38 as long as the terminal can be utilized to conduct electrical energy. Moreover, while the voltage source terminal 38 and the plug terminal 34 employ clamping components 37, 33 to interconnect the same with the ignition wire 32, other embodiments of the ignition wire assembly 30 may utilize other appropriate manners of interconnecting the terminals such as, but not limited to, adhesive, welding, and other mechanical fasteners.

As illustrated in FIG. 3, the ignition wire 32 is designed as a cable or cord of sorts. In other words, the ignition wire 32 is made up of a plurality of wire strands 40 that are at least one of twisted together, braided, weaved, or the like. This arrangement preferably prevents the ignition wire 32 from being stretched due to normal axial pulling forces imposed thereon in spark plug replacement procedures. As an example of the non-stretchable nature of the ignition wire 32, a weight of about 100 pounds or more may be suspended from the ignition wire assembly 30 without the ignition wire 32 undergoing a significant amount of stretching or extension. This ignition wire 32 maybe made of any of a number of appropriate conductive material(s). In one preferred embodiment, the ignition wire 32 is made of 64 strands of braided stainless steel wire forming a cable having a diameter of about 1/4 inch.

Still referring to FIG. 3, disposed about the ignition wire 32 is a radio frequency interference hindering device 42. This device 42 may be any of a number of appropriate devices for at least generally hindering emission of radio frequency interference from the ignition wire 32. In this case, the device 42 is a ferrite collar that is disposed about the ignition wire 32 near the plug terminal 34. It should be noted that numerous other locations of the device 42 may be appropriate. Moreover, some embodiments may include a plurality of devices 42 to hinder radio frequency emissions.

Figure 4:
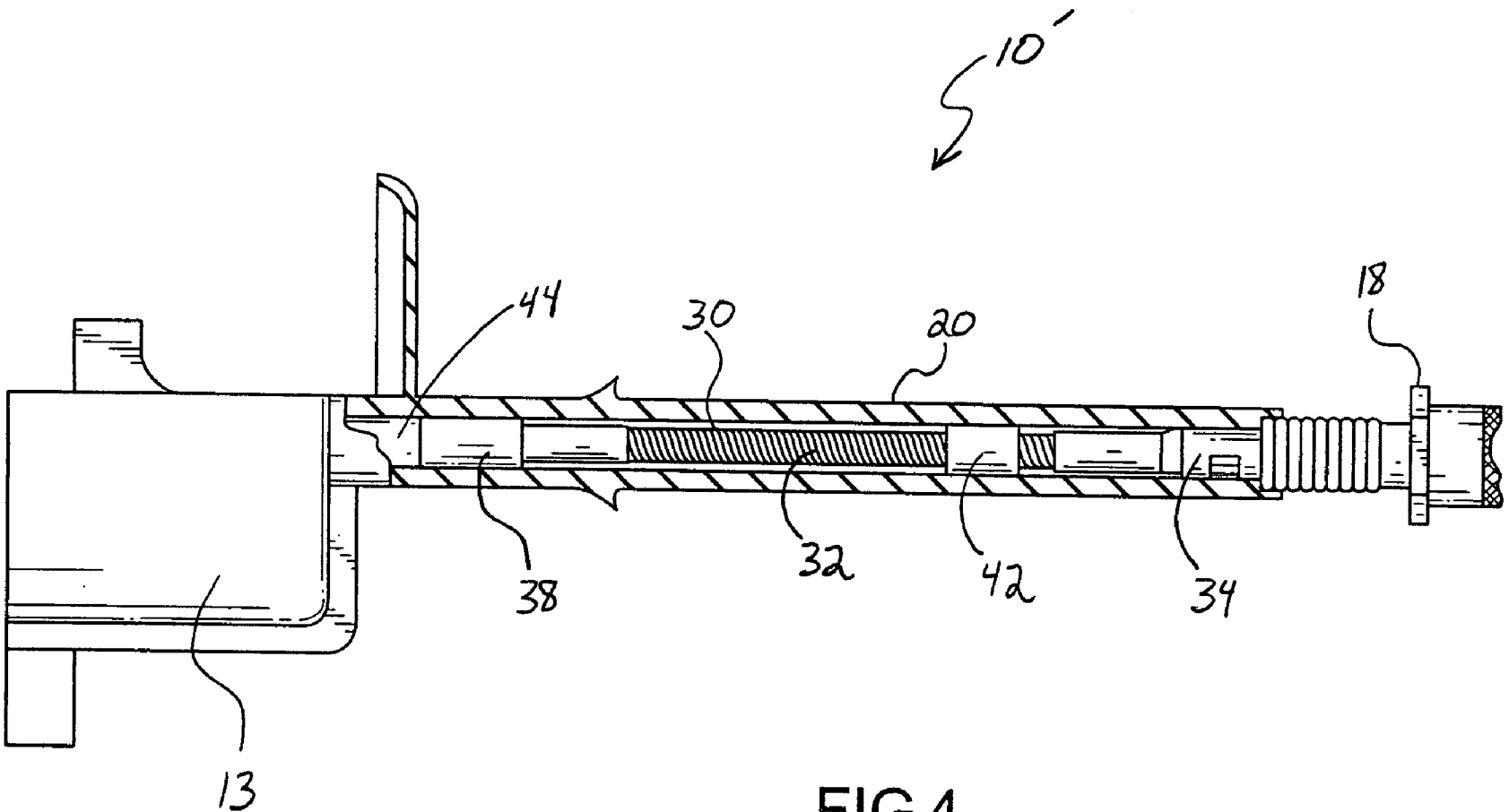
FIG. 4 is a partial cutaway view of a coil-on-plug assembly of the invention including the ignition wire assembly of FIG. 3.

FIG. 4 illustrates a coil-on-plug (COP) assembly 10' of the invention that includes the ignition wire assembly 30 of FIG. 3. The voltage source terminal 38 of the ignition wire 32 is shown as being electrically connected with a coil terminal 44 of a coil assembly that is located within the coil portion 13 of the insulating boot 20. Moreover, the plug terminal 34 of the ignition wire assembly 30 is shown as being electrically connected with the spark plug 18.

In one manner of using the COP assembly 10', electrical energy from a power distribution apparatus of a motor vehicle is conveyed to an on-board computer and then to an ignition module of the motor vehicle. This ignition module is appropriately interconnected with the coil assembly (via ignition terminal 46) so that electrical energy from the ignition module may be conveyed through the coil assembly and the coil terminal 44 thereof to the voltage source terminal 38 of the ignition wire assembly 30. The electrical energy is conducted from the voltage source terminal 38, through the ignition wire 32, through the plug terminal 34 and to the spark plug 18. While this ignition wire assembly 30 may be said to have certain structural benefits, it may also be characterized as a performance part. That is, the ignition wire assembly 30 may increase the performance of the engine with which it is associated by enabling the conduction of electrical energy while providing a resistance of no more than about 4.0 ohms.

Those skilled in the art will now see that certain modifications can be made to the assembly and related methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

What is claimed is:

1. A low resistance ignition wire assembly for use with an internal combustion engine, comprising:

an ignition wire that includes a plurality of non-insulated wire strands assembled into a conductor;

a ferrite collar encircling said ignition wire;

a plug terminal disposed at a first end of the ignition wire and electrically connectable with at least a portion of a spark plug; and a voltage source terminal disposed at a second end of the ignition wire opposite the first end, wherein the voltage source terminal is electrically interconnectable with a voltage source.

2. An ignition wire assembly, as claimed in claim 1, wherein:

the ignition wire is substantially non-stretchable.

3. An ignition wire assembly, as claimed in claim 1, wherein:

the ignition wire is made of stainless steel.

4. An ignition wire assembly, as claimed in claim 3, wherein:

the ignition wire has an effective diameter of about ⅛ inch to about ¼ inch.

5. An ignition wire assembly, comprising:

a substantially non-stretchable ignition wire;

a means for suppressing radio frequency emissions from said ignition wire;

a plug terminal disposed at a first end of the ignition wire and electrically connectable with at least a portion of a spark plug; and a voltage source terminal disposed at a second end of the ignition wire opposite the first end, wherein the voltage source terminal is electrically interconnectable with a voltage source.

6. An ignition wire assembly, as claimed in claim 5, wherein:

the ignition wire provides a resistance of no more than about 4 ohms.

7. An ignition wire assembly, as claimed in claim 5, wherein:

the ignition wire comprises a plurality of wires arranged as a cable.

8. An ignition wire assembly, as claimed in claim 5, wherein:

the ignition wire is made of stainless steel.

9. An ignition wire assembly, as claimed in claim 5, wherein in said means for suppressing radio frequency emissions from said ignition wire further comprises:

a ferrite collar disposed about the ignition wire.

10. A method of conducting electricity between a voltage source and a spark plug in an engine, the method comprising the steps of:

providing electrical energy from a coil of an engine to an ignition wire;

conducting the electrical current through the ignition wire and to a spark plug;

hindering the conducting step with a resistance of no more than about 4 ohms; and suppressing the emission of radio frequencies from said ignition wire.

11. A method, as claimed in claim 10, wherein:

the hindering step has substantially no resistance.

12. The method, as claimed in claim 10, wherein said step of suppressing radio frequency emissions from said ignition wire utilizes a ferrite collar encircling said ignition wire.

13. An ignition coil assembly, comprising:

a coil having a coil terminal;

an ignition wire that includes a plurality of non-insulated wire strands assembled into a conductor;

a means for suppressing radio frequency emissions from said ignition wire;

a connection terminal disposed at a first end of the ignition wire, wherein the connection terminal is electrically interconnected with the coil terminal of the coil;

a plug terminal disposed at a second end of the ignition wire opposite the first end and electrically connectable with at least a portion of a spark plug; and an electrically insulative boot disposed about the coil and the ignition wire.

14. An ignition coil assembly, as claimed in claim 13, wherein:

the ignition wire is substantially non-stretchable.

15. An ignition coil assembly, as claimed in claim 13, wherein:

the ignition wire is made of braided stainless steel.

16. The ignition coil assembly, as claimed in claim 13, wherein said means for suppressing radio frequency emissions from said ignition wire further comprises a ferrite collar encircling said ignition wire.

17. The ignition coil assembly, as claimed in claim 16, wherein said ferrite collar is located near the coil terminal.

18. The ignition coil assembly, as claimed in claim 13, wherein the resistance of said ignition wire is no more than about 4 ohms.

19. A low resistance ignition wire assembly for use in a vehicle requiring the suppression of radio frequency emissions from the ignition wire assembly comprising:

a non-coaxial ignition cable including a single conductor formed from a plurality of conductive elements;

a spark plug terminal electrically connected to a first end of said non-coaxial ignition cable; and a voltage source terminal disposed at a second, opposing end of said non-coaxial ignition cable; and a ferrite collar encircling said ignition cable.

20. An ignition wire assembly, as claimed in claim 19, wherein said plurality conductive elements further comprise a plurality of wire stands that are woven together.

21. An ignition wire assembly, as claimed in claim 19, wherein said plurality of conductive elements further comprises:

an inner core, said inner core including a stainless steel wire, and an outer core, said outer core including a winding of silver-plated copper wire around said inner core.

22. An ignition wire assembly, as claimed in claim 19, wherein said nonconductive ferrite collar encircling said non-coaxial ignition cable is located near said spark plug terminal.

23. An ignition wire assembly, as claimed in claim 19, wherein said ignition wire further comprises:

an insulating layer surrounding said single conductor between said voltage source terminal and said spark plug terminal; and a ferrite collar, said ferrite collar encircling said insulation layer and said ferrite collar being located near said voltage source terminal.

* * * * *